United States Patent [19]

Hoenig et al.

[11] 4,180,179

[45] Dec. 25, 1979

[54] BEADED SNAPLOCK CLOSURE

[75] Inventors: James R. Hoenig, Tinley Park; Salvador C. Mallorca, Downers Grove, both of Ill.

[73] Assignee: The Continental Group, Inc., New York, N.Y.

[21] Appl. No.: 938,620

[22] Filed: Aug. 31, 1978

[51] Int. Cl.[2] ..... B65D 39/00

[52] U.S. Cl. ..... 220/307; 220/354

[58] Field of Search ..... 220/307, 354

[56] References Cited

U.S. PATENT DOCUMENTS

| | | | |
|---|---|---|---|
| 2,775,362 | 12/1956 | Henchert | 220/354 |
| 3,105,621 | 10/1963 | Francis | 220/307 X |
| 3,420,397 | 1/1969 | Miller | 220/307 |

*Primary Examiner*—George T. Hall
*Attorney, Agent, or Firm*—Charles E. Brown

[57] ABSTRACT

An end unit of the type including an outer ring and a separately formed cover each having annular channels which interlock to secure the cover in place on the ring and form a seal between the cover and the ring. The interlock is improved selectively by interlocking beads on radially outer walls of the interlocking channels or by a socket in the radially outer wall of the ring channel and a radially inwardly projecting bead on the radially inner wall of the cover channel, the bead projecting into the socket. The interlocks permit greater tolerances in the manufacture of the end unit, particularly the interlocking channels. This also provides for greater tolerances in the application of the cover after the associated container has been filled.

10 Claims, 5 Drawing Figures

FIG. 1
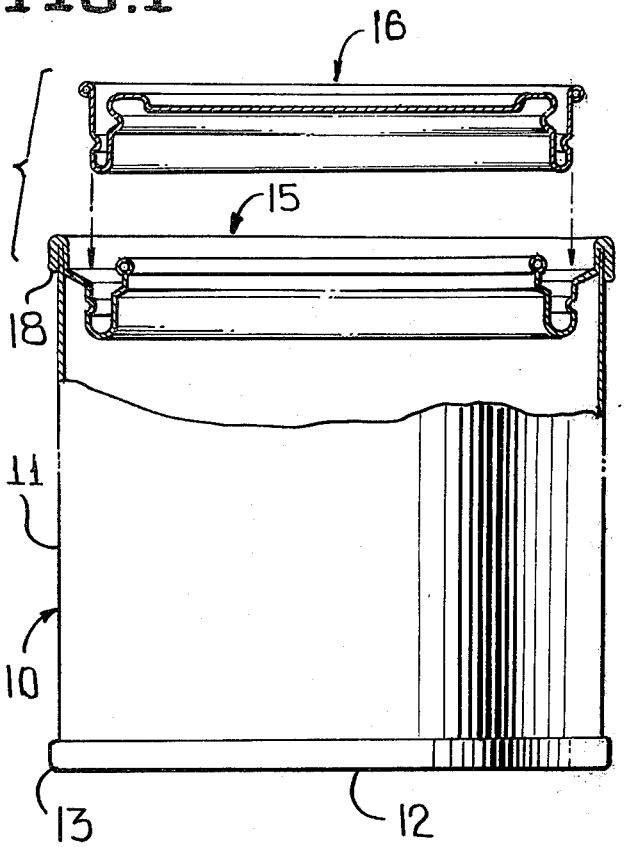
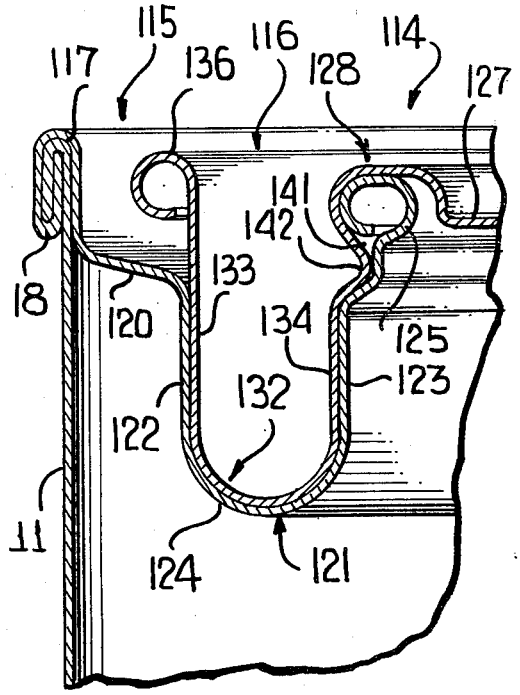
FIG. 3
FIG. 2
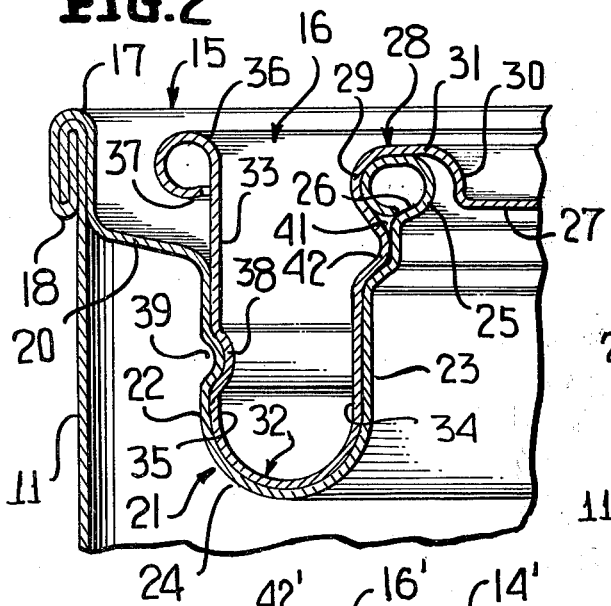
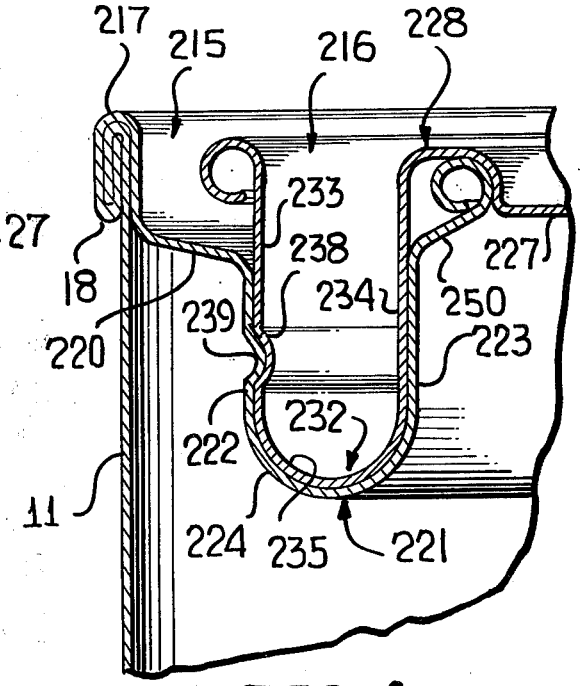
FIG. 4
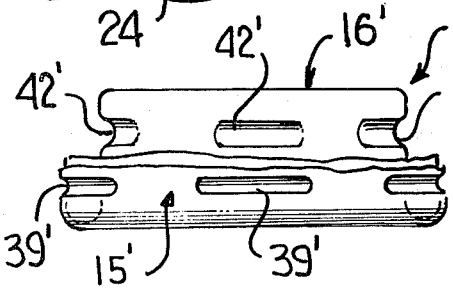
FIG. 5

BEADED SNAPLOCK CLOSURE

This invention relates in general to new and useful improvements in container constructions, and more particularly to a container end unit of the type having a separately formed cover which is removably and resecurably carried by a ring.

Most particularly, this invention relates to an end unit of the type having a separately formed removable cover and is of the type generally associated with paint cans. A typical example of the prior art is found in the U.S. Pat. to Henchert, No. 2,775,362 granted Dec. 25, 1956.

Present standards require that the cover be retained in place against blow-off when the container is subjected to an internal pressure of 10 p.s.i.g. Further, the container, when filled with a product, must withstand a drop test of four feet on a 45° Angle inclined surface. In this test the container lays on its side with the cover absorbing the impact.

In the past, the cover and ring have been coated with abrasive enamels or have been provided with tight friction fits in order to meet the blow-off and drop tests. These have been found to be undesirable, particularly the tight friction fit as provided for by Henchert, for example, in that such fits do not provide sufficient latitude in the manufacture of the cans or during insertion of the cover in the customer's plant.

In accordance with this invetion, the customary ring and cover assembly has been modified to provide beads which interlock so as to retain the cover in place when subjected to the test abuses. At the same time, there is still a sufficiently tight fit to provide a complete seal between the cover and the ring.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is an exploded side elevational view with parts broken away of a can in accordance with this invention.

FIG. 2 is an enlarged fragmentary vertical sectional view through the radially outer portion of the end unit, and shows the interlocks between the cover and the ring.

FIG. 3 is an enlarged fragmentary sectional view similar to FIG. 2, and shows a modified form of interlock.

FIG. 4 is another fragmentary sectional view similar to FIG. 2, and shows still another modified form of interlock.

FIG. 5 is an elevational view of the end unit with parts broken away, and shows interrupted beads.

Referring now to the drawings in detail, it will be seen that there is illustrated in FIG. 1 a conventional can having an end closure formed in accordance with this invention. The can may be of a type generally identified as a paint can, although it may obviously contain other products, and is generally identified by the numeral 10. The can 10 includes a cylindrical body 11 having the lower end thereof closed by a bottom end unit 12 secured to the body by a conventional seam 13. The upper end of the can body 11 is closed by a two-piece end unit formed in accordance with this invention, the end unit being generally identified by the numeral 14. Most specifically, the end unit 14 includes a ring, generally identified by the numeral 15, and a cover, generally identified by the numeral 16.

The ring 15 has a radially outer peripheral portion 17 which is configurated for forming a seam 18 with the container body 11. The ring 15 also includes an annular ring portion 20 disposed radially inwardly of the peripheral seam forming portion 16. Radially inwardly of the ring portion 29, the ring 15 is in the form of an annular axially outwardly opening U-shaped channel generally identified by the numeral 21. The channel 21 includes a radially outer wall 22 and a radially inner wall 23 joined by a bight portion 24. The ring 15 further has an innermost free edge portion in the form of an annular hollow bead 25 which in cross section is upwardly and radially outwardly turned with the free edge 26 of the ring 15 being generally radially inwardly directed.

The cover 14 includes a recessed circular portion 27 which is defined by an intermediate axially inwardly opening annular channel 28 which receives the bead 25. The channel 28 includes a radially outer wall 29, a radially inner wall 30, and an annular connecting portion 31.

The cover 16 also has a radially outer peripheral portion defining in cross section an axially outwardly opening U-shaped channel, generally identified by the numeral 32 and being received in the channel 21. The channel 32 has a radially outer wall 33 and a radially inner wall 34 joined by a bight portion 35. The wall 33 of the channel extends above the wall 34 and terminates in an annular hollow bead 36 which in part is defined by an edge portion 37 of the cover 16, which edge portion faces generally radially inwardly.

The end unit 14 thus described reads equally as well upon the end unit of Henchert U.S. Pat. No. 2,775,362. However, in accordance with this invention there are specific interlocks which permit a wider tolerance in the formation of the channels 21 and 32 while at the same time enables the end unit to meet the various tests.

First of all, the walls 22 and 33, instead of having completely straight lines in cross section, are provided with interlocking beads. Most specifically, the wall 33 is provided intermediate its height with a radially inwardly directed annular bead 38. A similarly shaped radially inwardly directed annular bead 39 is formed in the wall 22 and interlockingly rests within the bead 38 when the cover 16 is assembled with the ring 15. The interlocking of the beads 38, 39 serves to materially resist blow-off and also to retain the cover 16 in place when the container is dropped.

It is to be understood that when the cover 16 is assembled with the ring, there will be sufficient resiliency in the wall 33 to permit the wall 33 to deflect radially inwardly, and thus allow the channel 32 to be seated in the channel 21 in the manner illustrated in FIG. 2.

In accordance with the teaching of Henchert U.S. Pat. No. 2,775,362, the hollow bead 25 would be directly connected to the upper edge of the wall 23 by a radially inwardly and axially outwardly sloping ring portion. However, in accordance with this invention the upper edge portion of the wall 23 is radially inwardly offset as at 40 to define below the bead 25 an annular socket 41. It is to be noted that the bead 25 overlies the socket 41 and forms a portion of the wall thereof.

The radially inner wall 34 of the channel 32 is radially inwardly deformed immediately adjacent the wall 29 to define a radially inwardly directed annular bead 42 which projects into the socket 41 and interlocks beneath the bead 25. The interlock between the beads 42 and 25 also serves to retain the cover 16 in place against the forces applied thereto during handling and abuse.

Referring now to FIG. 3, it will be seen that there is illustrated a modified form of end unit which is identified by the numeral 114 and includes a ring 115 and a cover 116. The ring 115 is identical to the ring 15 except that the bead 39 is omitted and the corresponding wall 122 is completely straight in cross section. In a like manner, the cover 116 corresponds to the cover 16 with the exception that the bead 38 is omitted and the corresponding wall 133 is completely straight in cross section. On the other hand, the end unit 114 differs from that of Henchert U.S. Pat. No. 2,775,362 in that the radially inner wall 134 of the U-shaped channel 132 of the cover is provided with an annular radially inwardly directed bead 142 corresponding to the bead 42. The bead 142 is received in a socket 141, corresponding to the socket 41, and is interlocked beneath a hollow bead 125 corresponding to the hollow bead 25.

Reference is now made to FIG. 4, wherein a third form of end unit in accordance with this invention is illustrated and is generally identified by the numeral 214. The end unit 214 includes a ring 215 and a cover 216. The end unit 214 is substantially identical to the end unit 14 and employs interlocking beads 238 and 239 carried by the channel walls in the same manner as the beads 38, 39. On the other hand, the equivalent of the socket 41 and the bead 42 of the end unit 14 are absent. Instead, a radially inner wall 223 of the ring channel 221 has extending radially inwardly and axially outwardly therefrom an annular portion 250 which has directly connected thereto a hollow bead 225 corresponding to the hollow bead 25.

Further, the radially inner wall 234 of the cover U-shaped channel 232 is straight in cross section and forms a direct continuation of the wall 229 of the channel 228.

It is to be understood that the interlock of the beads 238, 239 is sufficient to permit certain tolerances in manufacture of the channels 231 and 232 so that the interlock between the cover 214 and the ring 215 will meet required tests.

It is to be understood that the beads 39 and 42 may be interrupted, and accordingly a modified end unit 14' is shown in FIG. 5 on a reduced scale. The interrupted beads are identified by the numerals 39' and 42'. It is to be understood that the beads 142 and 239 may also be interrupted.

Although several embodiments of the end unit formed in accordance with this invention have been specifically illustrated and described, it is to be understood that further modifications may be made in the end unit without departing from the spirit and scope of the invention as defined by the appended claims.

We claim:

1. An end unit for a container comprising a ring and a detachable separately formed cover; said ring having a radially outer peripheral portion for forming a seam with a container body, a ring portion disposed radially inwardly of said outer peripheral portion, and a radially inner peripheral portion defining in cross section an axially outwardly opening U-shaped channel, said ring having an innermost free edge portion in the form of an annular hollow bead extending axially outwardly of said U-shaped channel, said U-shaped channel in cross section having generally parallel sides; said cover having a recessed central portion defined by an intermediate axially inwardly opening annular channel receiving said ring hollow bead and being seated thereon, said cover having a radially outer peripheral portion defining in cross section an axially outwardly opening U-shaped channel received in said ring U-shaped channel, said cover U-shaped channel and said intermediate channel each having a wall forming a continuation of one another, said cover having a radially outermost free edge portion in the form of an annular hollow bead overlying said ring; said end unit being characterized by the radially outermost one of said ring U-shaped channel walls having an intermediate annular radially inwardly projecting bead, and the radially outermost one of said cover U-shaped channel walls having a complementary intermediate annular radially inwardly projecting bead receiving said ring radially inwardly projecting bead in releasable interlocking relation.

2. The end unit of claim 1 wherein said complementary beads are disposed generally mid-height of U-shaped channel walls.

3. The end unit of claim 1 wherein radially inner walls of said U-shaped channels are straight and parallel to one another.

4. The end unit of claim 1 wherein the radially inner wall of said ring U-shaped channel is radially inwardly offset adjacent said ring hollow bead to define an annular socket partially formed by said ring hollow bead, and the radially inner wall of said cover U-shaped channel having a radially inwardly directed annular bead disposed immediately adjacent said axially inwardly opening channel and seated in said annular socket.

5. The end unit of claim 4 wherein said annular bead of said cover U-shaped channel radially inner wall engages radially inwardly behind said ring hollow bead.

6. The end unit of claim 1 wherein said ring U-shaped channel annular bead is interrupted.

7. An end unit for a container comprising a ring and a detachable separately formed cover; said ring having a radially outer peripheral portion for forming a seam with a container body, a ring portion disposed radially inwardly of said outer peripheral portion, and a radially inner peripheral portion defining in cross section an axially outwardly opening U-shaped channel, said ring having an innermost free edge portion in the form of an annular hollow bead extending axially outwardly of said U-shaped channel, said U-shaped channel in cross section having generally parallel sides; said cover having a recessed central portion defined by an intermediate axially inwardly opening annular channel receiving said ring hollow bead and being seated thereon, said cover having a radially outer peripheral portion defining in cross section an axially outwardly opening U-shaped channel received in said ring U-shaped channel, said cover U-shaped channel and said intermediate channel each having a wall forming a continuation of one another, said cover having a radially outermost free edge portion in the form of an annular hollow bead overlying said ring; said end unit being characterized by the radially inner wall of said ring U-shaped channel being radially inwardly offset adjacent said ring hollow bead to define an annular socket partially formed by said ring hollow bead, and the radially inner wall of said cover U-shaped channel having a radially inwardly directed annular bead disposed immediately adjacent said axially inwardly opening channel and seated in said annular socket.

8. The end unit of claim 7 wherein said annular bead of said cover U-shaped channel radially inner wall engages radially inwardly behind said ring hollow bead.

9. The end unit of claim 7 wherein radially outer walls of said U-shaped channels are straight and parallel to one another.

10. The end unit of claim 7 wherein said cover U-shaped channel annular bead is interrupted.

* * * * *